US009719733B2

(12) United States Patent
Yang

(10) Patent No.: US 9,719,733 B2
(45) Date of Patent: Aug. 1, 2017

(54) TRI-PIECE THERMAL ENERGY BODY HEAT EXCHANGER HAVING MULTI-LAYER PIPELINE AND TRANSFERRING HEAT TO EXTERIOR THROUGH OUTER PERIPHERY OF PIPELINE

(71) Applicant: Tai-Her Yang, Dzan-Hwa (TW)

(72) Inventor: Tai-Her Yang, Dzan-Hwa (TW)

( * ) Notice: Subject to any disclaimer, the term of this patent is extended or adjusted under 35 U.S.C. 154(b) by 526 days.

(21) Appl. No.: 14/045,051

(22) Filed: Oct. 3, 2013

(65) Prior Publication Data

US 2014/0083667 A1 Mar. 27, 2014

Related U.S. Application Data

(63) Continuation-in-part of application No. 13/628,116, filed on Sep. 27, 2012, now abandoned.

(51) Int. Cl.

| | |
|---|---|
| ***F28D 7/10*** | (2006.01) |
| ***F28F 1/00*** | (2006.01) |
| ***F28D 13/00*** | (2006.01) |
| ***F28D 7/00*** | (2006.01) |
| ***F28F 1/36*** | (2006.01) |
| *F28D 9/00* | (2006.01) |
| *F28D 7/02* | (2006.01) |
| *F28D 7/08* | (2006.01) |

(52) U.S. Cl.

CPC ..... *F28F 1/003* (2013.01); *F28D 7/0083* (2013.01); *F28D 7/106* (2013.01); *F28F 1/36* (2013.01); *F28D 7/022* (2013.01); *F28D 7/085* (2013.01); *F28D 9/0093* (2013.01)

(58) Field of Classification Search

CPC ..... F28F 1/003; F28D 7/0083; F28D 7/106; F28D 7/022; F28D 9/0093

USPC ..... 165/140, 141, 104.16

See application file for complete search history.

(56) References Cited

U.S. PATENT DOCUMENTS 872,175 A * 11/1907 Griesser ..... F28D 7/103 165/141
1,798,330 A * 3/1931 Leek ..... F22D 1/006 165/141
1,833,876 A * 11/1931 McGrath ..... F28D 7/026 122/32

(Continued)

FOREIGN PATENT DOCUMENTS

DE WO 2009062487 A2 * 5/2009 ..... F28D 1/0417

OTHER PUBLICATIONS

Translation of International Patent Document WO 2009062487 A2 entitled Translation—WO 2009062487 A2, translated Nov. 2015.*

*Primary Examiner* — Justin Jonaitis
*Assistant Examiner* — Paul Alvare
(74) *Attorney, Agent, or Firm* — Bacon & Thomas, PLLC

(57) ABSTRACT

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

13 Claims, 6 Drawing Sheets

(56) References Cited

U.S. PATENT DOCUMENTS 2,858,677 A * 11/1958 Stone ..... F28D 7/08
123/41.49
3,907,028 A * 9/1975 Lawson ..... F28D 7/022
138/38

* cited by examiner

TRI-PIECE THERMAL ENERGY BODY HEAT EXCHANGER HAVING MULTI-LAYER PIPELINE AND TRANSFERRING HEAT TO EXTERIOR THROUGH OUTER PERIPHERY OF PIPELINE

CROSS REFERENCE TO RELATED APPLICATION

This is a Continuation-In-Part of application Ser. No. 13/628,116 filed on Sep. 27, 2012.

BACKGROUND OF THE INVENTION (a) Field of the Invention

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

(b) Description of the Prior Art

In a conventional heat exchanger which utilizes the outer layer of a pipeline for transferring heat to the exterior, the temperature equalization is often performed through the fluid passing the pipeline and the fluid passing the outer layer of the pipeline, or with the solid member or fluid which is in contact with the outer layer of pipeline, therefore only a two-piece thermal energy body heat exchanger can be formed.

SUMMARY OF THE INVENTION

The configuration of the present invention is that an inner layer pipeline having a relatively smaller outer diameter is adopted as a first flow guiding pipe member (101), the first flow guiding pipe member (101) is made of a heat conductive member, and the pipe hole of the first flow guiding pipe member (101) is formed as a first flow path (102), two ends of the first flow path (102) are respectively formed as a first flow gathering chamber (103) and a first fluid inlet/outlet port (104), thereby allowing a first thermal energy body (105) formed in a fluid state to flow in or flow out; and an outer layer pipeline having an inner diameter larger than the outer diameter of the first flow path (102) is adopted as a second flow guiding pipe member (201) thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively through a second flow gathering chamber (203) and a second fluid inlet/outlet port (204), thereby allowing a second thermal energy body (205) formed in a fluid state to flow in and flow out, wherein the outer periphery of the outer layer pipeline of the second flow path (202) is in contact with a natural thermal energy body formed by stratum, earth soil, ocean, river, lake, pond, flowing fluid, atmosphere, or flowing air, or the thermal energy body formed by the fluid artificially installed in the sink, pool or container, said thermal energy body including formed in gaseous, liquid or solid state thermal energy body is served as a third thermal energy body (305), thereby forming the function of three-layer annular tri-piece thermal energy body heat exchange, so the heat exchanging and transferring can be performed among the second thermal energy body (205) and the first thermal energy body (105) and the third thermal energy body (305).

DESCRIPTION OF MAIN COMPONENT SYMBOLS

Figure 2:
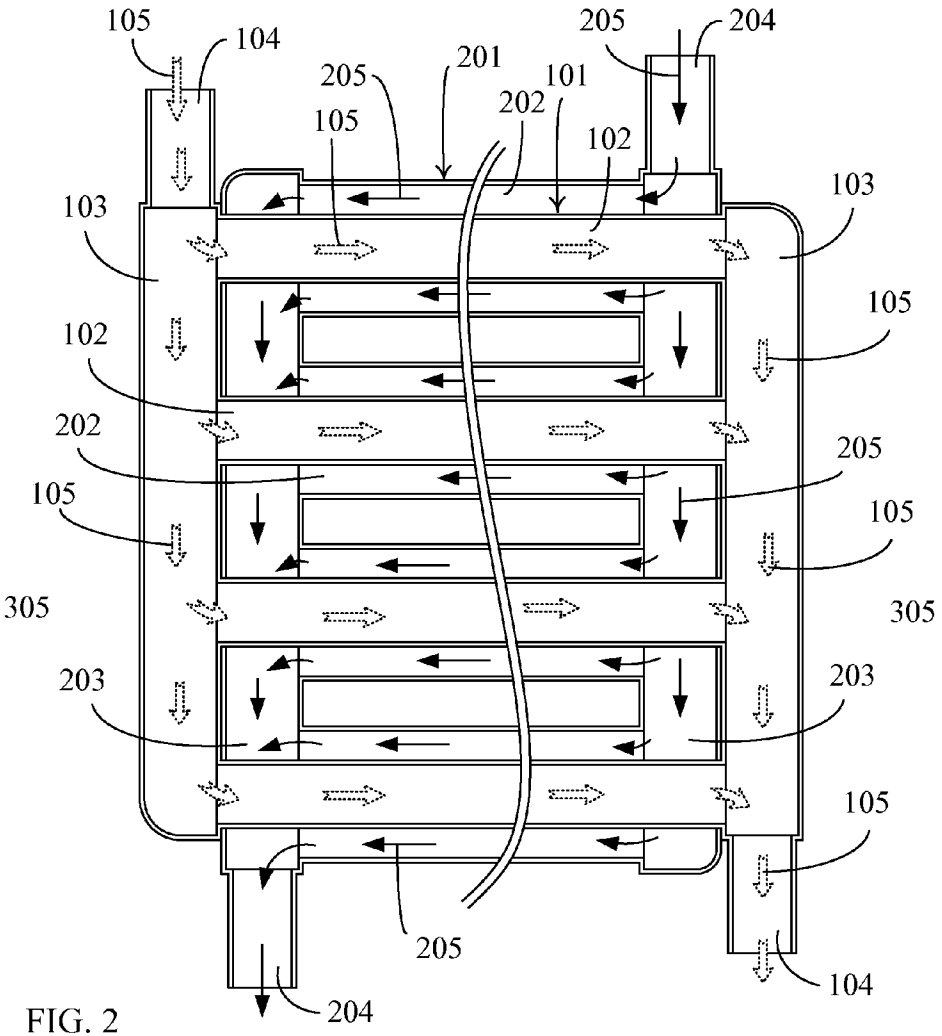
FIG. 2 is a lateral cross sectional view showing the main structure disclosed in FIG. 1.

101: first flow guiding pipe member
102: first flow path
103: first flow gathering chamber
104: first fluid inlet/outlet port
105: first thermal energy body
111, 222: spiral flow guiding sheet
201: second flow guiding pipe member
202: second flow path
203: second flow gathering chamber

204: second fluid inlet/outlet port
205: second thermal energy body
305: third thermal energy body
400: fluid pump
1000: heat conduction fin

DETAILED DESCRIPTION OF THE PREFERRED EMBODIMENTS

In a conventional heat exchanger which utilizes the outer layer of a pipeline for transferring heat to the exterior, the temperature equalization is often performed through the fluid passing the pipeline and the fluid passing the outer layer of the pipeline, or with the solid member or fluid which is in contact with the outer layer of pipeline, therefore only a two-piece thermal energy body heat exchanger can be formed.

The present invention provides a tri-piece thermal energy body heat exchanger having multi-layer pipeline and transferring heat to exterior through outer periphery of pipeline, which is configured by multiple layers of pipelines sleeved with each other, the fluid in the outer layer pipeline covers the inner layer pipeline for exchanging heat with the fluid in the inner layer pipeline, and the fluid in the outer layer pipeline is further used for transferring heat to the solid or fluid state thermal energy body which is in contact with the outer periphery of the outer layer pipeline, thereby forming a three-layer annular tri-piece thermal energy body heat exchanger.

The configuration of the present invention is that an inner layer pipeline having a relatively smaller outer diameter is adopted as a first flow guiding pipe member (101), the first flow guiding pipe member (101) is made of a heat conductive member, and the pipe hole of the first flow guiding pipe member (101) is formed as a first flow path (102), two ends of the first flow path (102) are respectively formed as a first flow gathering chamber (103) and a first fluid inlet/outlet port (104), thereby allowing a first thermal energy body (105) formed in a fluid state to flow in or flow out; and an outer layer pipeline having an inner diameter larger than the outer diameter of the first flow path (102) is adopted as a second flow guiding pipe member (201) thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively formed as a second flow gathering chamber (203) and a second fluid inlet/outlet port (204), thereby allowing a second thermal energy body (205) formed in a fluid state to flow in and flow out, wherein the outer periphery of the outer layer pipeline of the second flow path (202) is in contact with a natural thermal energy body formed by stratum, earth soil, ocean, river, lake, pond, flowing fluid, atmosphere, or flowing air, or the thermal energy body formed by the fluid artificially installed in the sink, pool or container, said thermal energy body including formed in gaseous, liquid or solid state thermal energy body is served as a third thermal energy body (305), thereby forming the function of three-layer annular tri-piece thermal energy body heat exchange, so the heat exchanging and transferring can be performed among the second thermal energy body (205) and the first thermal energy body (105) and the third thermal energy body (305).

Figure 1:
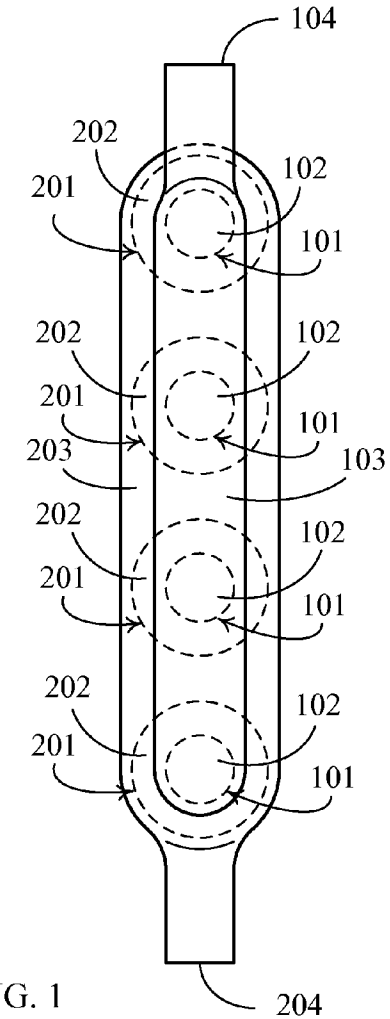
FIG. 1 is a front view showing the main structure according to one embodiment of the present invention.

The main configuration is illustrated as followings:

FIG. 1 is a front view showing the main structure according to one embodiment of the present invention;

FIG. 2 is a lateral cross sectional view showing the main structure disclosed in FIG. 1;

According to the tri-piece thermal energy body heat exchanger having multi-layer pipeline and transferring heat to exterior through outer periphery of pipeline shown in FIG. 1 and FIG. 2, the main configuration is provided with a first flow guiding pipe member (101) of one or more than one route, the first flow guiding pipe member (101) is made of a heat conductive member, and the pipe hole of the first flow guiding pipe member (101) is formed as a first flow path (102), two ends of the first flow path (102) are respectively through a first flow gathering chamber (103) and a first fluid inlet/outlet port (104), thereby allowing a first thermal energy body (105) formed in a fluid state to flow in or flow out; and the exterior of the first flow guiding pipe member (101) is sleeved and installed with the second flow guiding pipe member (201) of one or more than one route having an inner diameter larger than the outer diameter of the first flow guiding pipe member (101), thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, two ends of the second flow path (202) are respectively through a second flow gathering chamber (203) and a second fluid inlet/outlet port (204), thereby allowing a second thermal energy body (205) formed in a fluid state to flow in and flow out, wherein the outer layer of the second flow guiding pipe member (201) is in contact with a third thermal energy body (305) formed in a gaseous or liquid state or a solid thermal energy body, thereby forming a three-layer annular tri-piece thermal energy body heat exchanger, so the heat exchanging and transferring can be performed among the second thermal energy body (205) and the first thermal energy body (105) and the third thermal energy body (305);

- the mentioned first flow guiding pipe member (101) and the second flow guiding pipe member (201) can be formed in one or more than one route;
- the mentioned first flow guiding pipe member (101) and the second flow guiding pipe member (201) can be configured by pipe members formed in circular or rectangular or oval or other geometric shapes;
- the mentioned first flow guiding pipe member (101) and the second flow guiding pipe member (201) can be configured by pipe members having the same or different shapes;
- the mentioned first thermal energy body (105) and the second thermal energy body (205) can be formed by the same or different fluids, including formed by the gaseous or liquid fluid or the fluid capable of converting into a gaseous state from a liquid state or converting into a liquid state from a gaseous state;
- the flow direction of the first thermal energy body (105) flowing in the first flow guiding pipe member (101) and the flow direction of the second thermal energy body (205) flowing in the second flow guiding pipe member (201) can be the same or different.

Figure 4:
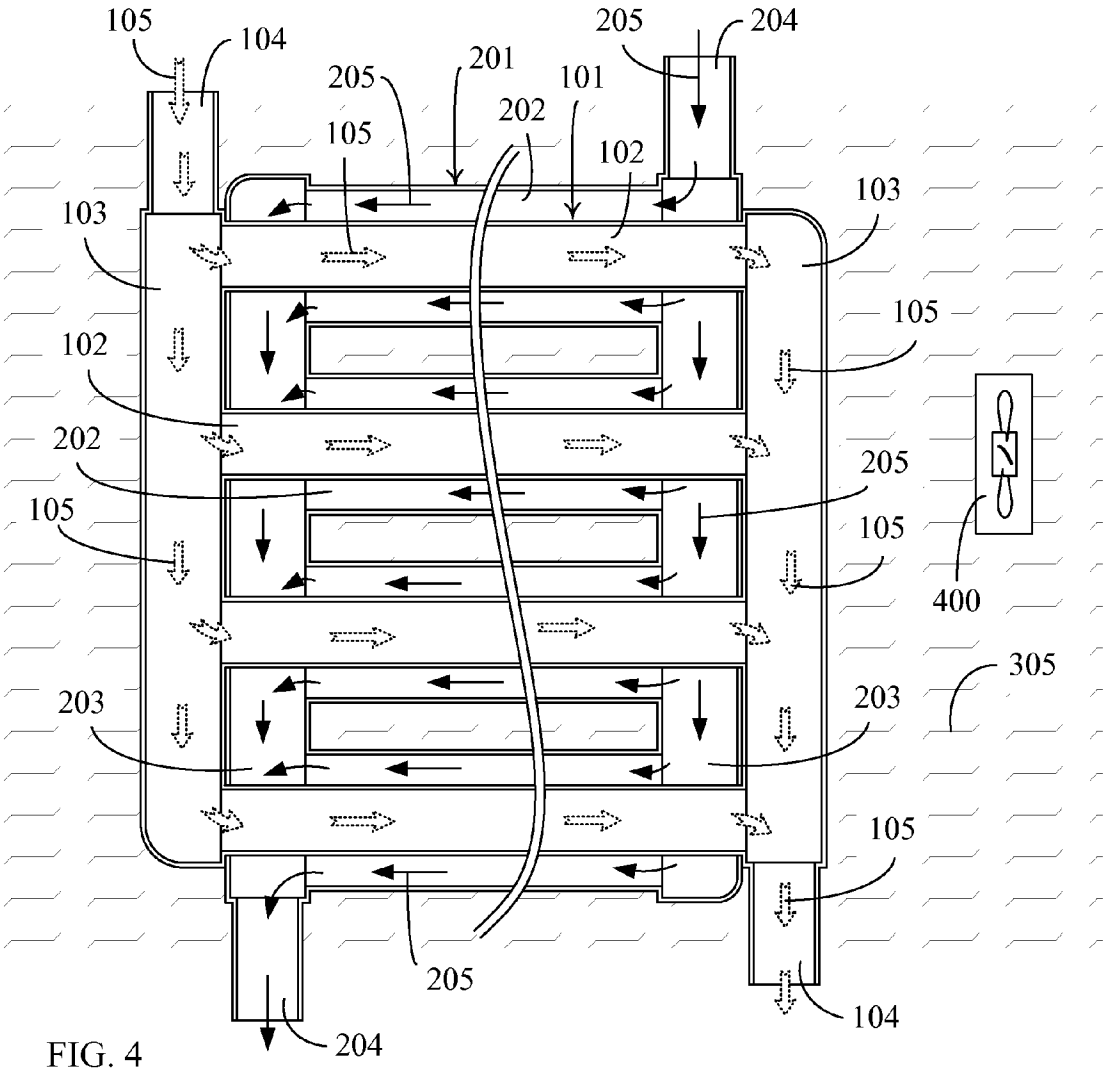
FIG. 4 is a lateral cross sectional view showing the main structure disclosed in FIG. 3.
Figure 3:
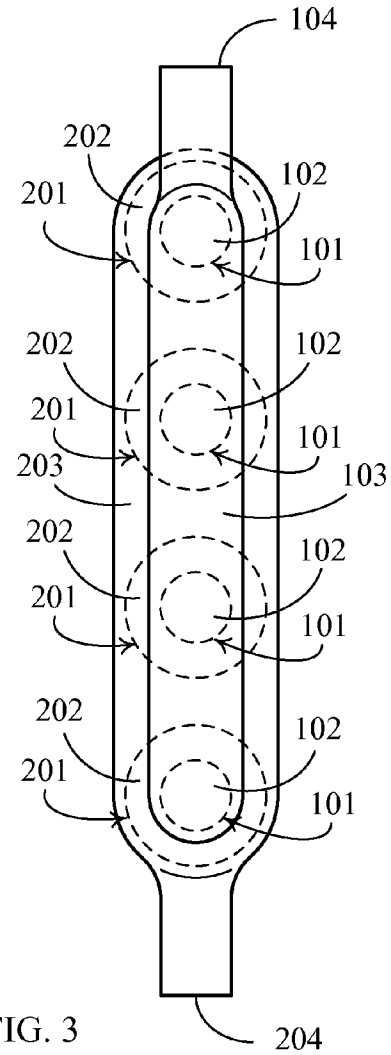
FIG. 3 is a front view illustrating the third thermal energy body disclosed in the embodiment shown FIG. 1 being formed in a fluid state and a fluid pump being installed.

According to tri-piece thermal energy body heat exchanger having multi-layer pipeline and transferring heat to exterior through outer periphery of pipeline, when the third thermal energy body (305) is formed by gaseous or liquid fluid, a fluid pump (400) can be additionally installed for pumping the third thermal energy body (305) thereby enhancing the heat exchange effect;

FIG. 3 is a front view illustrating the third thermal energy body disclosed in the embodiment shown FIG. 1 being formed in a fluid state and a fluid pump being installed;

FIG. 4 is a lateral cross sectional view showing the main structure disclosed in FIG. 3;

As shown in FIG. 3 and FIG. 4, the fluid pump (400) is additionally installed for pumping the fluid (305) thereby enhancing the heat exchange effect.

Figure 5:
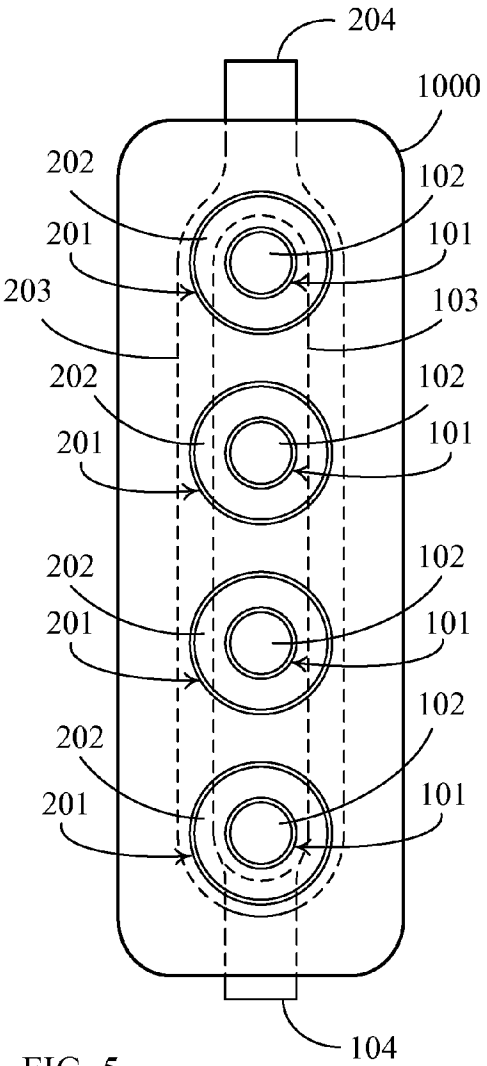
FIG. 5 is a frontal cross sectional view showing the embodiments shown in FIG. 1 and FIG. 2 being additionally installed with a heat conduction fin (1000).

FIG. 5 is a frontal cross sectional view showing the embodiments shown in FIG. 1 and FIG. 2 being additionally installed with a heat conduction fin (1000).

Figure 6:
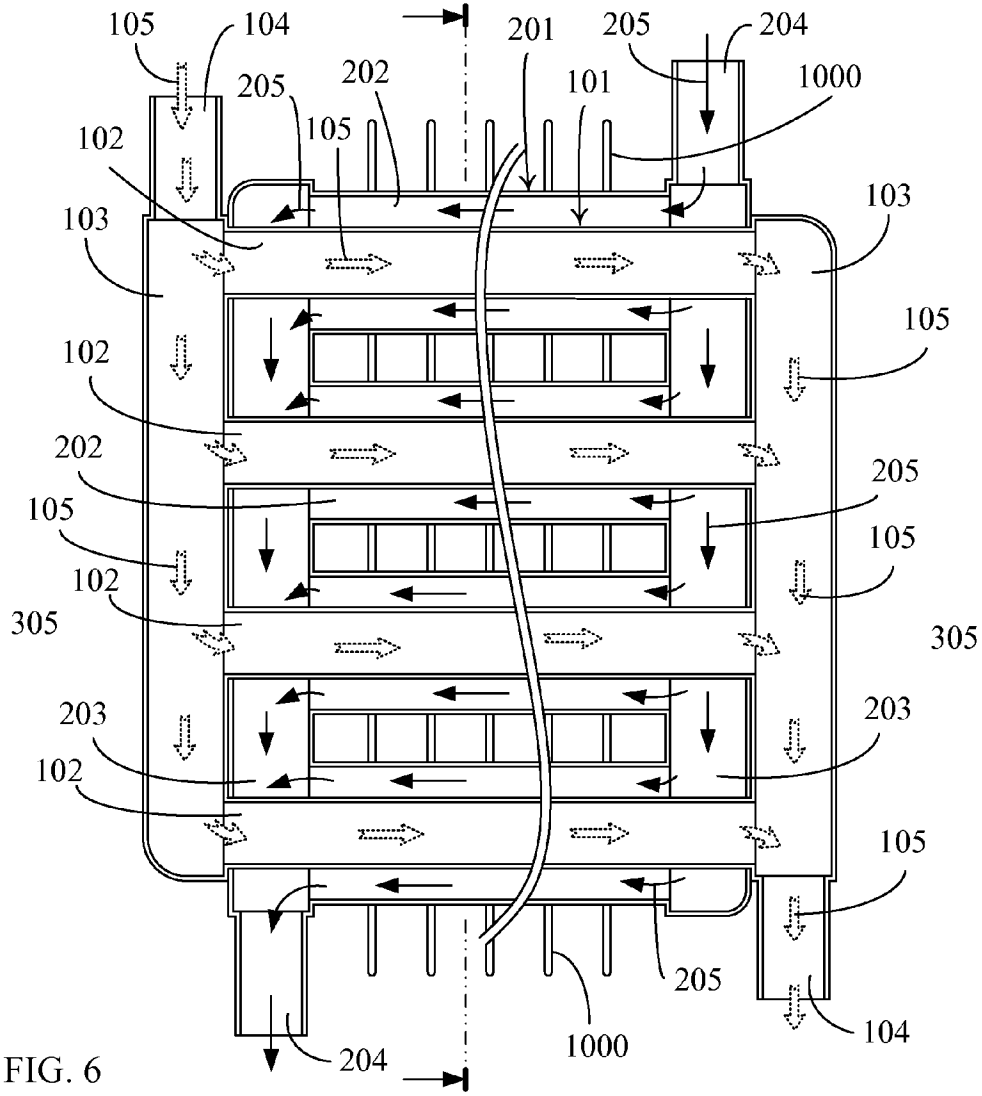
FIG. 6 is a lateral cross sectional view showing the main structure disclosed in FIG. 5.

FIG. 6 is a lateral cross sectional view showing the main structure disclosed in FIG. 5.

As shown in FIG. 5 and FIG. 6, the second flow guiding pipe member (201) in the embodiments of FIG. 1 and FIG. 2 is further installed with a heat conduction fin (1000) for transferring the thermal energy between the second flow guiding pipe member (201) and the third thermal energy body (305).

Figure 8:
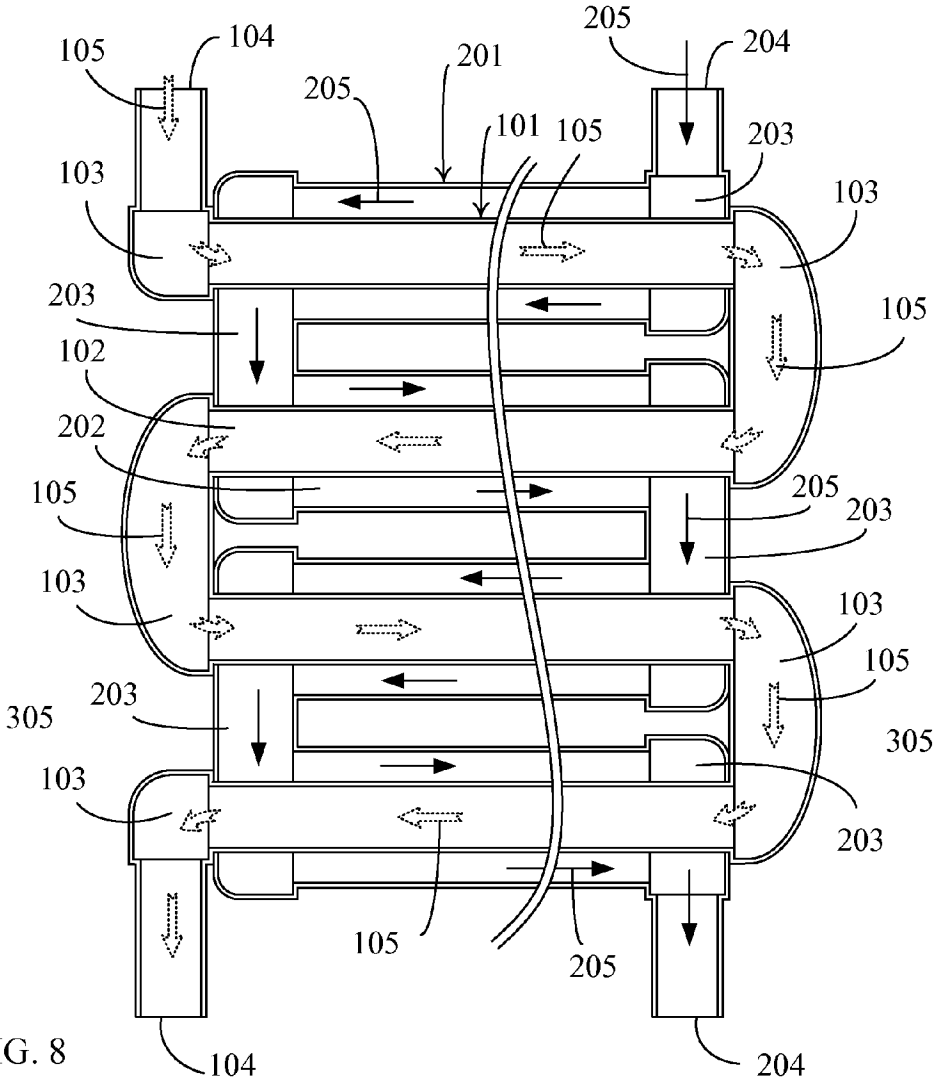
FIG. 8 is a lateral cross sectional view showing the main structure disclosed in FIG. 7.
Figure 7:
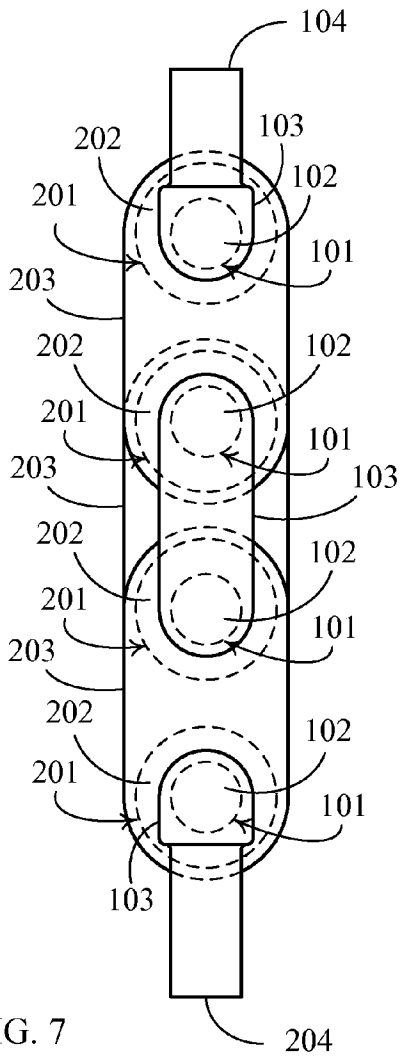
FIG. 7 is a front view illustrating each section of the first flow guiding pipe member (101) disclosed in the embodiments shown FIG. 1 and FIG. 2 being connected in series, and each section the first flow path (102) disclosed in the embodiments shown FIG. 1 and FIG. 2 being connected in series also.

According to the tri-piece thermal energy body heat exchanger having multi-layer pipeline and transferring heat to exterior through outer periphery of pipeline of the present invention, each section of the first flow guiding pipe member (101) and/or the second flow guiding pipe member (201) shown in FIG. 1 and FIG. 2 except for being connected in parallel, the first flow guiding pipe member (101) and the second flow guiding pipe member (201) can also be connected in serial; the detail description is as follows:

FIG. 7 is a front view illustrating each section of the first flow guiding pipe member (101) disclosed in the embodiments shown in FIG. 1 and FIG. 2 being connected in series, and each section of the second flow guiding pipe member (201) which is sleeved and installed at the exterior of the first flow guiding pipe member (101) disclosed in the embodiments shown in FIG. 1 and FIG. 2 being connected in series also;

FIG. 8 is a lateral cross sectional view showing the main structure disclosed in FIG. 7.

As shown in FIG. 7 and FIG. 8, each section of the first flow guiding pipe member (101) disclosed in the embodiments shown FIG. 1 and FIG. 2 is made to connect in serial, and each section of the second flow guiding pipe member (201) which is sleeved and installed at the exterior of the first flow guiding pipe member (101) disclosed in the embodiments shown in FIG. 1 and FIG. 2 is made to connect in series also, the first flow guiding pipe member (101) is made of a heat conductive member, the first flow path (102) is connected in series with the first flow path (102) of at least one first flow guiding pipe member (101) through the first flow gathering chamber (103), two ends of the series-connected first flow path (102) are respectively formed as a first fluid inlet/outlet port (104), thereby allowing a first thermal energy body (105) formed in a fluid state to flow in or flow out; and the second flow guiding pipe member (201) having an inner diameter larger than the outer diameter of the first flow guiding pipe member (101) is sleeved and installed at the exterior of the first flow guiding pipe member (101), thereby forming a structure having two layers of pipelines, the second flow guiding pipe member (201) is made of a heat conductive member, and the diameter difference defined between the larger inner diameter of the second flow guiding pipe member (201) and the outer diameter of the first flow guiding pipe member (101) forms a second flow path (202) having an annular cross section, the second flow path (202) is connected in series with the second flow path (202) of at least one second flow guiding pipe member (201) through the second flow gathering chamber (203), then two ends of the series-connected second flow path (202) are respectively formed as a second fluid inlet/outlet port (204), thereby allowing a second thermal energy body (205) formed in a fluid state to flow in and flow out, wherein the outer layer of the second flow guiding pipe member (201) is in contact with a third thermal energy body (305) formed in a gaseous or liquid state or a solid thermal energy body, thereby forming a three-layer annular tri-piece thermal energy body heat exchanger, so the heat exchanging and transferring can be performed among the second thermal energy body (205) and the first thermal energy body (105) and the third thermal energy body (305).

Figure 10:
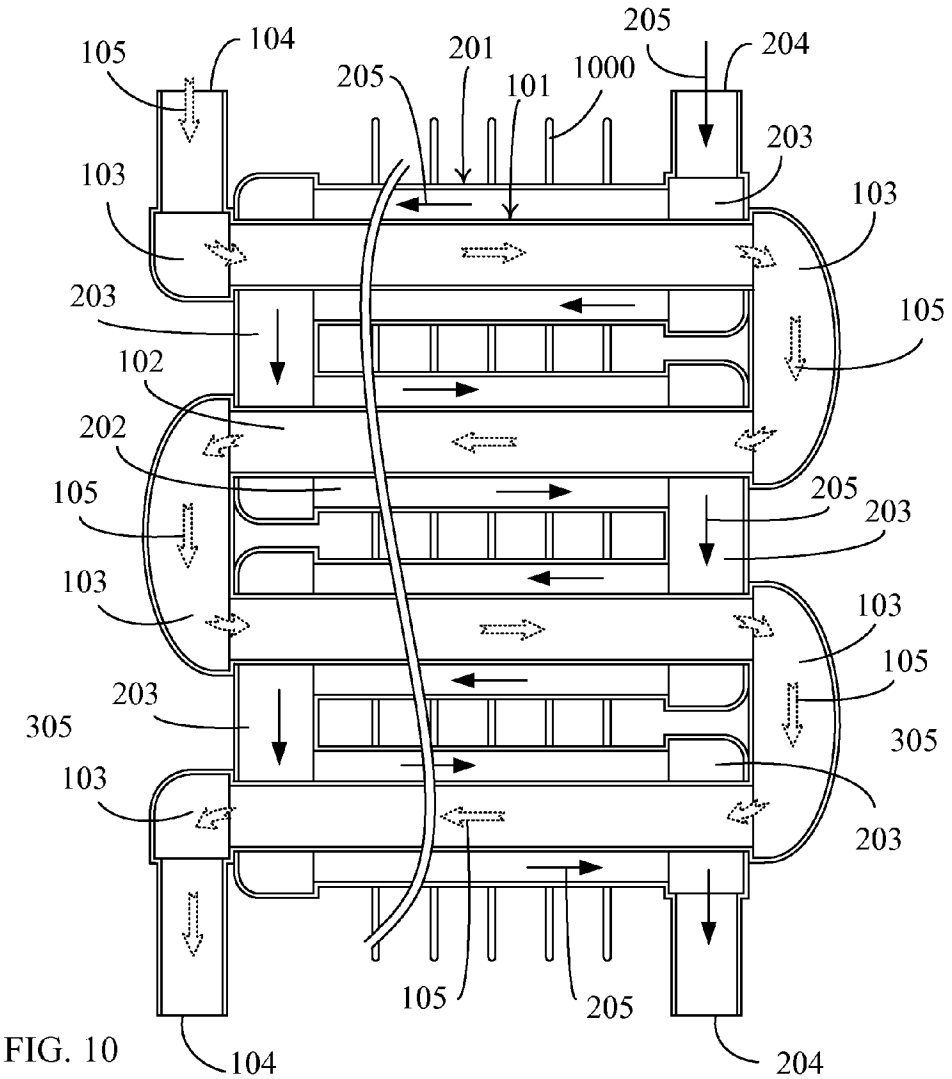
FIG. 10 is a lateral cross sectional view showing the main structure disclosed in FIG. 10.
Figure 9:
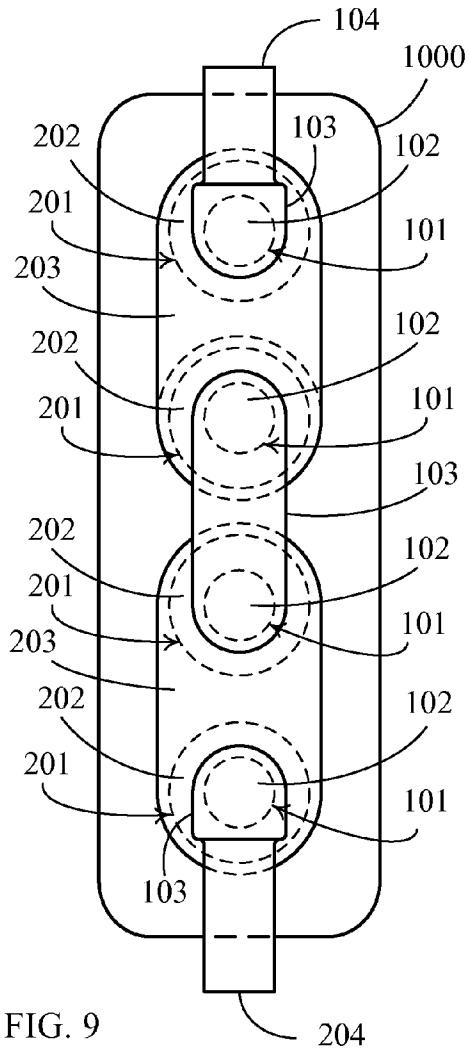
FIG. 9 is a front view illustrating each section of the first flow guiding pipe member (101) disclosed in the embodiments shown FIG. 5 and FIG. 6 being connected in series, and each section the first flow path (102) disclosed in the embodiments shown FIG. 5 and FIG. 6 being connected in series also.

FIG. 9 is a front view illustrating each section of the first flow guiding pipe member (101) disclosed in the embodiments shown in FIG. 5 and FIG. 6 being connected in series, and each section of the second flow guiding pipe member (201) which is sleeved and installed at the exterior of the first flow guiding pipe member (101) disclosed in the embodiments shown in FIG. 5 and FIG. 6 being connected in series also;

FIG. 10 is a lateral cross sectional view showing the main structure disclosed in FIG. 10.

As shown in FIG. 9 and FIG. 10, each section of the first flow guiding pipe member (101) disclosed in the embodiments shown FIG. 5 and FIG. 6 is made to connect in serial, and each section of the second flow guiding pipe member (201) which is sleeved and installed at the exterior of the first flow guiding pipe member (101) disclosed in the embodiments shown in FIG. 5 and FIG. 6 is made to connect in series also.

Figure 11:
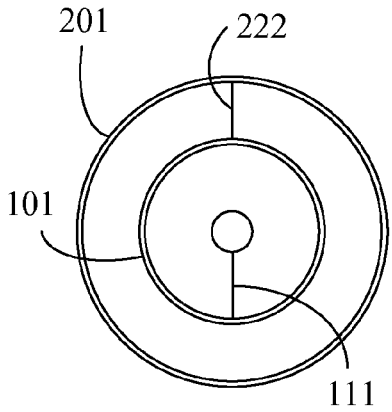
FIG. 11 is a front view of the embodiment illustrating the first flow guiding pipe member (101) and/or the first flow path (102) is installed within a spiral flow guiding sheet in the same spiral flowing direction.

According to the tri-piece thermal energy body heat exchanger having multi-layer pipeline and transferring heat to exterior through outer periphery of pipeline of the present invention, a spiral flow guiding sheet (222) is further formed between the exterior of the first flow guiding pipe member (101) and the interior of the second flow guiding pipe member (201) and/or a spiral flow guiding sheet (111) is further formed at the interior of the first flow guiding pipe member (101), so as to enhance the heat transfer effect; the detailed description is as follows:

FIG. 11 is a front view of the embodiment illustrating a spiral flow guiding sheet structure (222) in the same spiral flowing direction is installed between the exterior of the first flow guiding pipe member (101) and the interior of the second flow guiding pipe member (201) and/or a spiral flow guiding sheet structure (111) in the same spiral flowing direction is installed at the interior of the first flow guiding pipe member (101).

Figure 12:
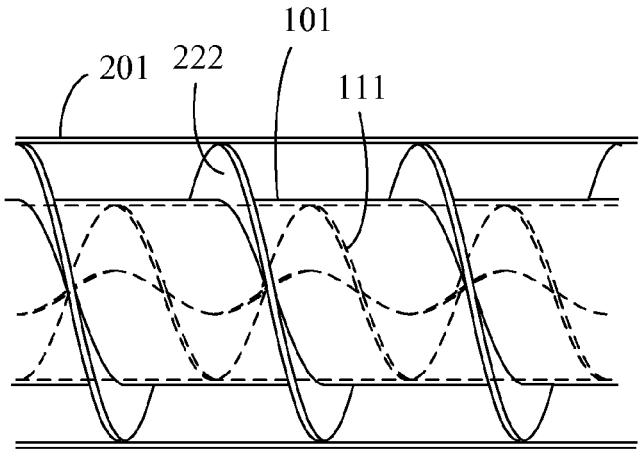
FIG. 12 is a lateral cross sectional view showing the main structure disclosed in FIG. 11.

FIG. 12 is a lateral cross sectional view showing the main structure disclosed in FIG. 11.

As shown in FIG. 11 and FIG. 12, a spiral flow guiding sheet structure (222) in the same spiral flowing direction is installed between the exterior of the first flow guiding pipe member (101) and the interior of the second flow guiding pipe member (201) and/or a spiral flow guiding sheet structure (111) in the same spiral flowing direction is installed at the interior of the first flow guiding pipe member (101).

Figure 13:
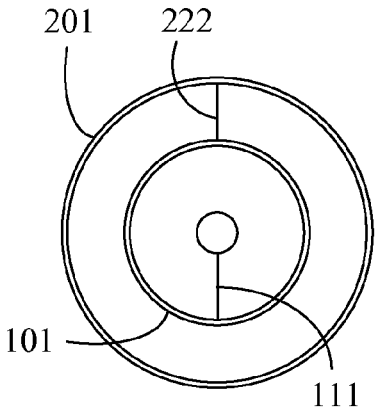
FIG. 13 is a front view of the embodiment illustrating the first flow guiding pipe member (101) and/or the first flow path (102) is installed within a spiral flow guiding sheet in different spiral flowing direction.

FIG. 13 is a front view of the embodiment illustrating a spiral flow guiding sheet structure (222) in different spiral flowing direction is installed between the exterior of the first flow guiding pipe member (101) and the interior of the second flow guiding pipe member (201) and/or a spiral flow guiding sheet structure (222) in different spiral flowing direction is installed at the interior of the first flow guiding pipe member (101).

Figure 14:
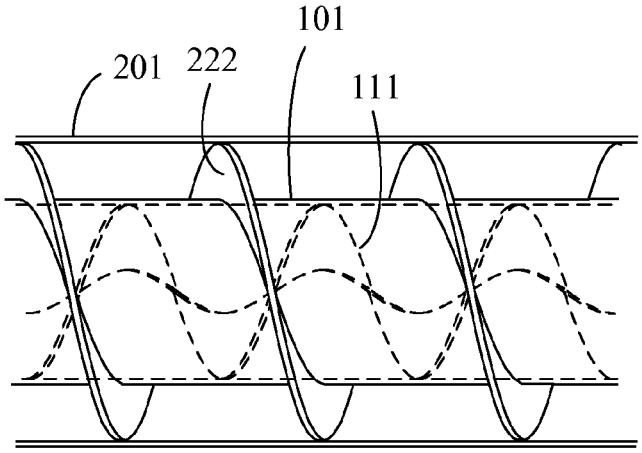
FIG. 14 is a lateral cross sectional view showing the main structure disclosed in FIG. 13.

FIG. 14 is a lateral cross sectional view showing the main structure disclosed in FIG. 13.

As shown in FIG. 13 and FIG. 14, a spiral flow guiding sheet structure (222) in different spiral flowing direction is installed between the exterior of the first flow guiding pipe member (101) and the interior of the second flow guiding pipe member (201) and/or a spiral flow guiding sheet structure (222) in different spiral flowing direction is installed at the interior of the first flow guiding pipe member (101).

The invention claimed is:

1. A tri-piece thermal energy body heat exchanger having first and second vertical sides and a multi-layer pipeline and transferring heat to an exterior through an outer periphery of the pipeline comprising: a first flow guiding pipe member (101) connected with at least one further first flow guiding pipe member (101) through a first flow gathering chamber (103) to form a first flow path (102), two ends of the connected first flow path (102) being formed as a first top fluid inlet/outlet port (104) at a top of the first vertical side of the heat exchanger and a first bottom fluid inlet/outlet port (104) at a bottom of either the first vertical side or the second vertical side of the heat exchanger, the first fluid inlet/outlet ports (104) each being respectively connected to the first flow guiding pipe member (101) and one of the at least one further first flow guiding pipe member (101) by a further said first flow gathering chamber (103), thereby allowing a first thermal energy body (105) formed in a fluid state to flow in or flow out through the first top fluid inlet/outlet port (104) at the top of the first vertical side and correspondingly flow out or flow in through the first bottom fluid inlet/outlet port (104) at the bottom of the heat exchanger; and a second flow guiding pipe member (201) having an inner diameter larger than the outer diameter of the first flow guiding pipe member (101), the second flow guiding pipe being sleeved and installed at the exterior of the first flow guiding pipe member (101), thereby both the first flow guiding pipe member (101) and the second flow guiding pipe member (201) forming a structure having two layers of pipelines, and the diameter difference defined between the inner diameter of the second flow guiding pipe member (201) and the outer diameter of the first flow guiding pipe member (101) forming a second flow path (202) having an annular cross section, the second flow guiding pipe member (201) being connected with at least one further second flow guiding pipe member (201) through a second flow gathering chamber (203) to form a second flow path (202), then two ends of the connected second flow path (202) are each formed as a second top fluid inlet/outlet port (204) at a top of the second vertical side of the heat exchanger and a second bottom fluid inlet/outlet port (204) at the bottom of either the first vertical side or the second vertical side of the heat exchanger at a position opposite the first bottom fluid inlet/outlet port (104), the second fluid inlet/outlet ports (204) being respectively connected to the second flow guiding pipe member (201) and one of the at least one further second flow guiding pipe member (201) by a further said second flow gathering chamber (203), thereby allowing a second thermal energy body (205) formed in a fluid state to flow in or flow out through the second top inlet/outlet port (204) at the top of the second vertical side and correspondingly flow out or flow in through the second bottom inlet/outlet port (204) at the bottom of the heat exchanger to thereby cause the second thermal energy body (205) to flow through the second flow guiding pipe members (201) in a direction opposite to a flow direction of the first thermal energy body (105) through the first flow guiding pipe members (101), wherein the outer layer of the second flow guiding pipe member (201) is in contact with a third thermal energy body (305) formed in a gaseous or liquid state or a solid thermal energy body, thereby forming a three-layer annular tri-piece thermal energy body heat exchanger, so that the heat exchanging and transferring is performed among the second thermal energy body (205) and the first thermal energy body (105) and the third thermal energy body (305), wherein both the first flow guiding pipe member connection to form the first flow path (102) and the second flow guiding pipe member connection to form the second flow path (202) are series connections, wherein the first flow gathering and further first flow gathering chambers (103) are independent and mutually spaced structures each having a curved exterior surface alternately extending from first sections of the first and second vertical sides of the heat exchanger, and wherein the second flow gathering and further second flow gathering chambers (203) are independent and mutually spaced structures situated on second sections of the first and second vertical sides of the heat exchanger that are horizontally opposite the first sections of the first and second vertical sides from which the first flow gather and further first flow gathering chambers (103) extend.

2. A tri-piece thermal energy body heat exchanger having multi-layer pipeline and transferring heat to exterior through outer periphery of pipeline as claimed in claim 1, wherein the mentioned first flow guiding pipe member (101) and the second flow guiding pipe member (201) is configured by pipe members formed in circular or rectangular or oval or other geometric shapes.

3. A tri-piece thermal energy body heat exchanger having multi-layer pipeline and transferring heat to exterior through outer periphery of pipeline as claimed in claim 1, wherein the mentioned first flow guiding pipe member (101) and the second flow guiding pipe member (201) is configured by pipe members having the same or different shapes.

4. A tri-piece thermal energy body heat exchanger having multi-layer pipeline and transferring heat to exterior through outer periphery of pipeline as claimed in claim 1, wherein the first thermal energy body (105) and the second thermal energy body (205) are formed by the same or different fluids.

5. A tri-piece thermal energy body heat exchanger having multi-layer pipeline and transferring heat to exterior through outer periphery of pipeline as claimed in claim 1, wherein at least one of said first thermal energy body (105) and said second thermal energy body (205) is in one of said gaseous or liquid state, or is capable of being converted into a gaseous state from a liquid state or converted into a liquid state from a gaseous state.

6. A tri-piece thermal energy body heat exchanger having multi-layer pipeline and transferring heat to exterior through outer periphery of pipeline as claimed in claim 1, wherein the mentioned third thermal energy body (305) is formed by fluid or solid member.

7. A tri-piece thermal energy body heat exchanger having multi-layer pipeline and transferring heat to exterior through outer periphery of pipeline as claimed in claim 1, wherein when the third thermal energy body (305) is formed by fluid, a fluid pump (400) is additionally installed for pumping the third thermal energy body (305) thereby enhancing the heat exchange effect.

8. A tri-piece thermal energy body heat exchanger having multi-layer pipeline and transferring heat to exterior through outer periphery of pipeline as claimed in claim 1, wherein the flow direction of the first thermal energy body (105) flowing in the first flow guiding pipe member (101) and the flow direction of the second thermal energy body (205) flowing in the second flow guiding pipe member (201) is the same or different.

9. A tri-piece thermal energy body heat exchanger having multi-layer pipeline and transferring heat to exterior through outer periphery of pipeline as claimed in claim 1, wherein the sleeved multi-layer pipe members includes being configured by two or more layers of heat conductive members, and the flow guiding pipe members having the corresponding quantity are therefore formed, so that the same or different fluids flow in each pipe member, and the flow direction in which the fluid flowing in different flow guiding pipelines arranged in adjacent layers is the same or different.

10. A tri-piece thermal energy body heat exchanger having multi-layer pipeline and transferring heat to exterior through outer periphery of pipeline as claimed in claim 1, wherein the second flow guiding pipe member (201) is further installed with a heat conduction fin (1000).

11. A tri-piece thermal energy body heat exchanger having multi-layer pipeline and transferring heat to exterior through outer periphery of pipeline as claimed in claim 1, wherein a spiral flow guiding sheet (222) is further formed between the exterior of the first flow guiding pipe member (101) and the interior of the second flow guiding pipe member (201) and/or a spiral flow guiding sheet (111) is further formed at the interior of the first flow guiding pipe member (101), so as to enhance the heat transfer effect.

12. A tri-piece thermal energy body heat exchanger having multi-layer pipeline and transferring heat to exterior through outer periphery of pipeline as claimed in claim 1, wherein a first spiral flow guiding sheet structure (222) is installed between the exterior of the first flow guiding pipe member (101) and the interior of the second flow guiding pipe member (201) and a second spiral flow guiding sheet structure (111) is installed at the interior of the first flow guiding pipe member (101), wherein the first spiral flow guiding sheet structure (222) and the second spiral flow guiding sheet structure (111) have a same spiral direction.

13. A tri-piece thermal energy body heat exchanger having multi-layer pipeline and transferring heat to exterior through outer periphery of pipeline as claimed in claim 1, wherein a first spiral flow guiding sheet structure (222) is installed between the exterior of the first flow guiding pipe member (101) and the interior of the second flow guiding pipe member (201) and a second spiral flow guiding sheet structure (111) is installed at the interior of the first flow guiding pipe member (101), wherein the first spiral flow guiding sheet structure (222) and the second spiral flow guiding sheet structure (111) have a different spiral direction.

* * * * *